US007081055B2

(12) United States Patent
Hsu

(10) Patent No.: US 7,081,055 B2
(45) Date of Patent: Jul. 25, 2006

(54) METHOD FOR MAKING RACKETS WITH SHOCK ABSORBING MEMBERS

(76) Inventor: Henry Hsu, No. 325, Sec. 3, Hueijhong Rd., Taichung City (TW)

( * ) Notice: Subject to any disclaimer, the term of this patent is extended or adjusted under 35 U.S.C. 154(b) by 15 days.

(21) Appl. No.: 10/962,423

(22) Filed: Oct. 13, 2004

(65) Prior Publication Data

US 2006/0079353 A1 Apr. 13, 2006

(51) Int. Cl.
*A63B 49/02* (2006.01)

(52) U.S. Cl. ..... 473/521; 473/537; 473/546

(58) Field of Classification Search ..... 473/520, 473/521, 537, 546
See application file for complete search history.

(56) References Cited

U.S. PATENT DOCUMENTS 4,906,002 A * 3/1990 Goffney et al. ..... 473/531
5,865,694 A * 2/1999 Duong-Van ..... 473/520
6,402,645 B1 * 6/2002 Liao ..... 473/520
6,537,164 B1 * 3/2003 Hsu ..... 473/521
6,579,198 B1 * 6/2003 Yoneyama ..... 473/544
6,663,514 B1 * 12/2003 Niwa et al. ..... 473/521
6,966,855 B1 * 11/2005 Yu ..... 473/521
2005/0003911 A1 * 1/2005 Yu ..... 473/521

* cited by examiner

*Primary Examiner*—Raleigh W. Chiu
(74) *Attorney, Agent, or Firm*—Rosenberg, Klein & Lee

(57) ABSTRACT

A racket includes a head and a shaft, a throat is connected between the head and the shaft. Shock absorbing members are installed to desired positions of the racket so as to reduce impact transferred to the player's hand. Two throat extensions extend from the head and two shaft extensions extend from an end of shaft. Each shaft extension has an insertion. The shock absorbing members are mounted onto the insertions and sandwiched between the throat extension and the insertions. A section of the shock absorbing members extends from an opening of the throat extensions and overlaps on an outer surface of the shaft extensions.

3 Claims, 10 Drawing Sheets

METHOD FOR MAKING RACKETS WITH SHOCK ABSORBING MEMBERS

FIELD OF THE INVENTION

The present invention relates to a method for making a racket that has shock absorbing members connected to the throat or shaft. The shock absorbing members includes protrusions and recesses on two opposites thereof.

BACKGROUND OF THE INVENTION

A conventional racket such as a tennis racket generally includes a head 12, a throat 13 and a shaft 11. The throat is connected between the frame and the shaft. Strings are connected in the head so as to hit the ball. FIGS. 1 to 2 show the conventional way to manufacture a sport racket and includes a step of wrapping prepreg material into a head and a shaft of the racket, a step of putting the raw material into a mold "A" and heating the mold "A" to solidify the prepreg material, a step of sanding the surface of the racket, a step of coloring the racket, and a step of installing accessories of the racket. The impact that the head bears when the ball hits on the head can be huge that the user's hand cannot hold the handle properly. Therefore, manufacturers try to reduce the impact and vibration on the racket. Most of the manufacturers put shock absorbing material on the sides of the head or on the shaft, and that cannot be satisfied because the shock absorbing material does not located at accurate positions and the thickness and weight limit the performance of the shock absorbing material. U.S. Pat. No. 4,284,275 to Fletcher discloses a polyurethane gripping material which is mounted to the handle of rackets. The gripping material has a thickness limitation and absorbs limited vibration. U.S. Pat. No. 5,695,418 to Huang discloses a shock absorbing grip that has the same problems and limitations as U.S. Pat. No. 4,284,275. U.S. Pat. No. 6,537,146 requires a cylindrical bar and two shock absorbing pieces are connected to the two ends of the bar. The bar is connected between the head portion and the shank so as to reduce impact transferred to the players' hand. However, the more number of parts the higher possibility that the racket involves manufacturing defects. A higher manufacturing cost is also expected.

SUMMARY OF THE INVENTION

The present invention relates to a racket with shock absorbing members and comprises a head having two throat extensions extending therefrom and a shaft having two shaft extensions extending from an end thereof. Each shaft extension has an insertion onto which a shock absorbing member is mounted and the throat extension is mounted to each of the insertions with the shock absorbing members. A section of the shock absorbing members extends from an opening of the throat extensions and overlaps on an outer surface of the shaft extensions. The shock absorbing members each include protrusions on a first side thereof and recesses defined in a second side.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
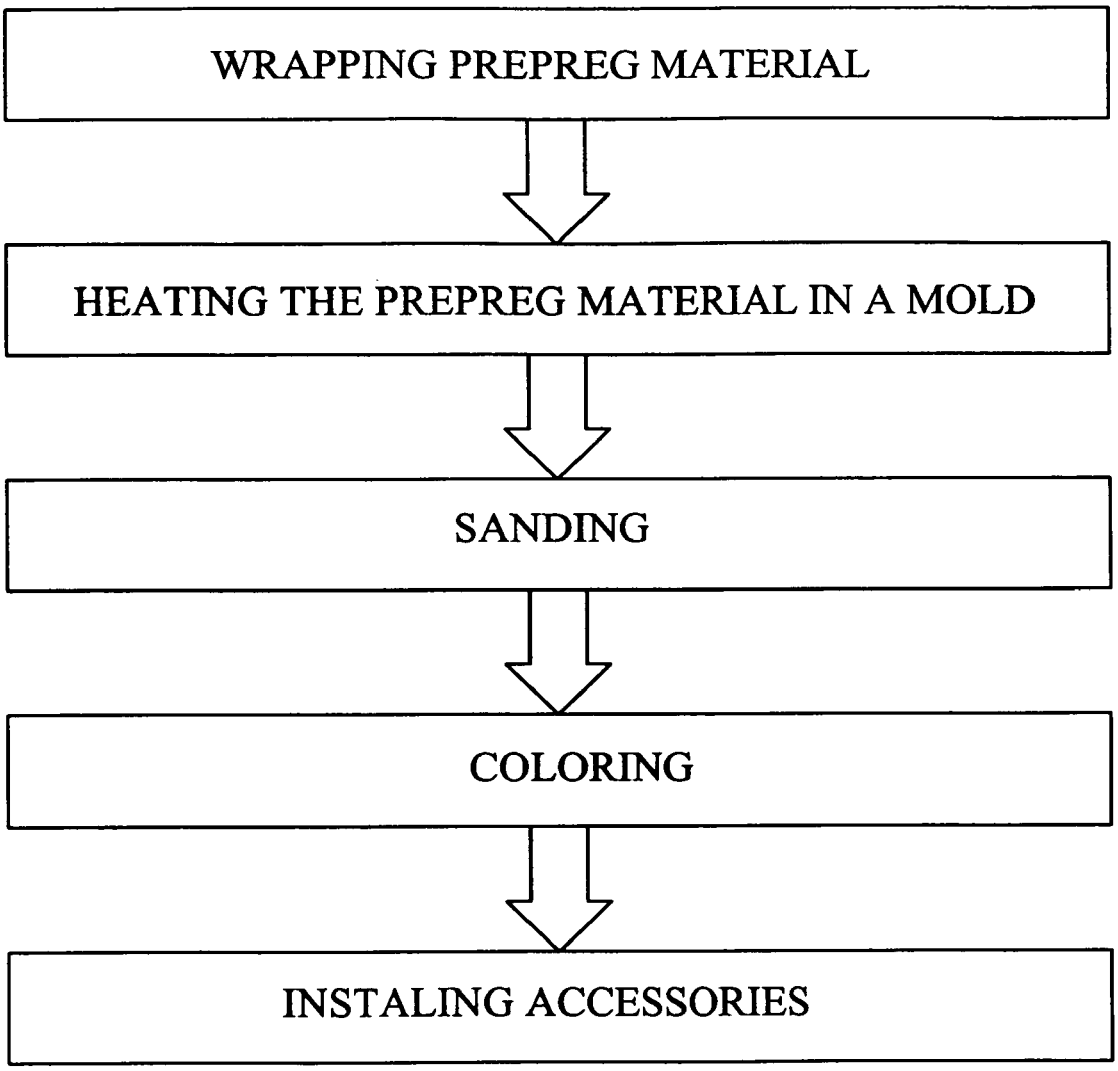
FIG.1 PRIOR ART
FIG. 1 is a flow chart to illustrate a conventional way to manufacture a racket.
Figure 2:
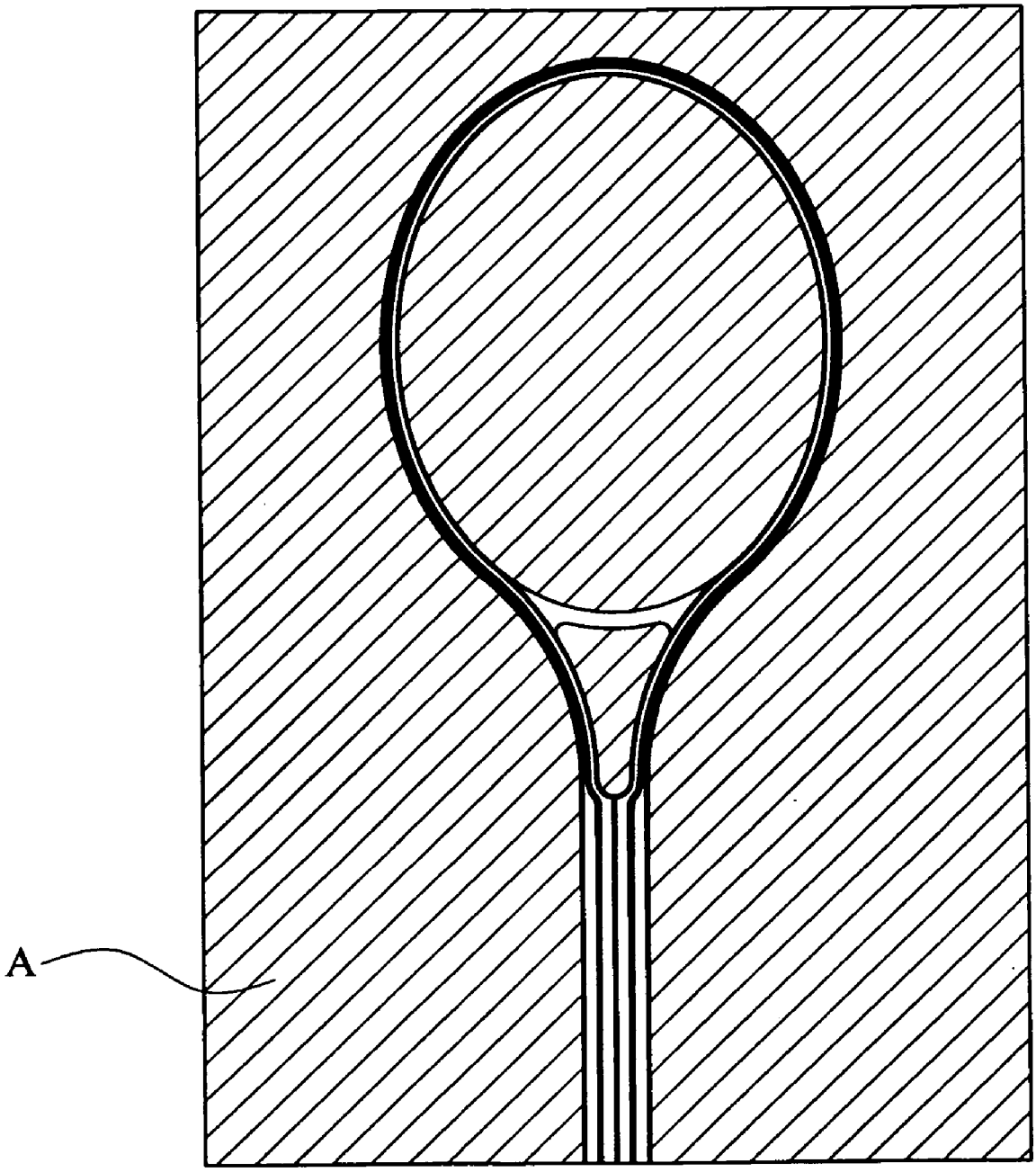
FIG.2 PRIOR ART
FIG. 2 is a cross sectional view to show the conventional racket is formed in a mold.
Figure 3:
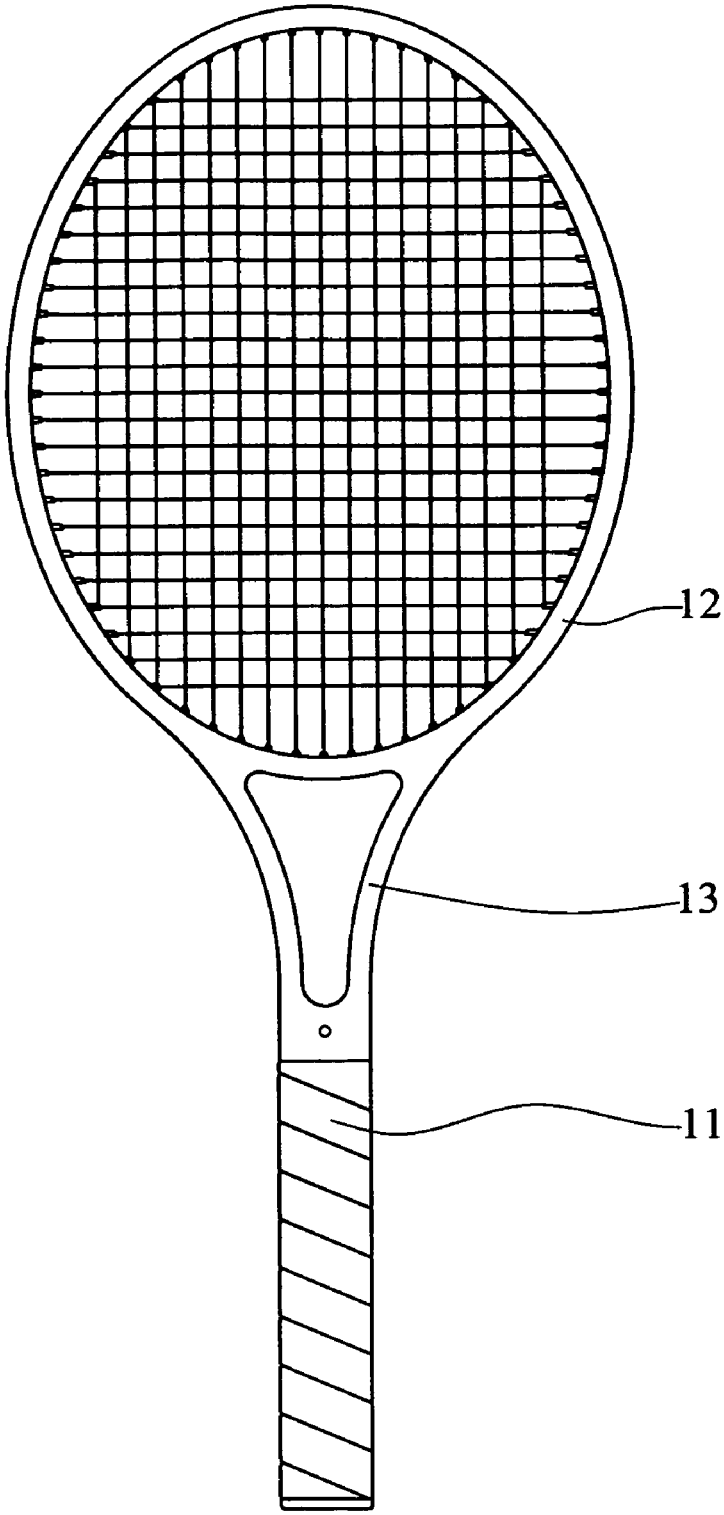
FIG.3 PRIOR ART
FIG. 3 shows the conventional racket.
Figure 4:
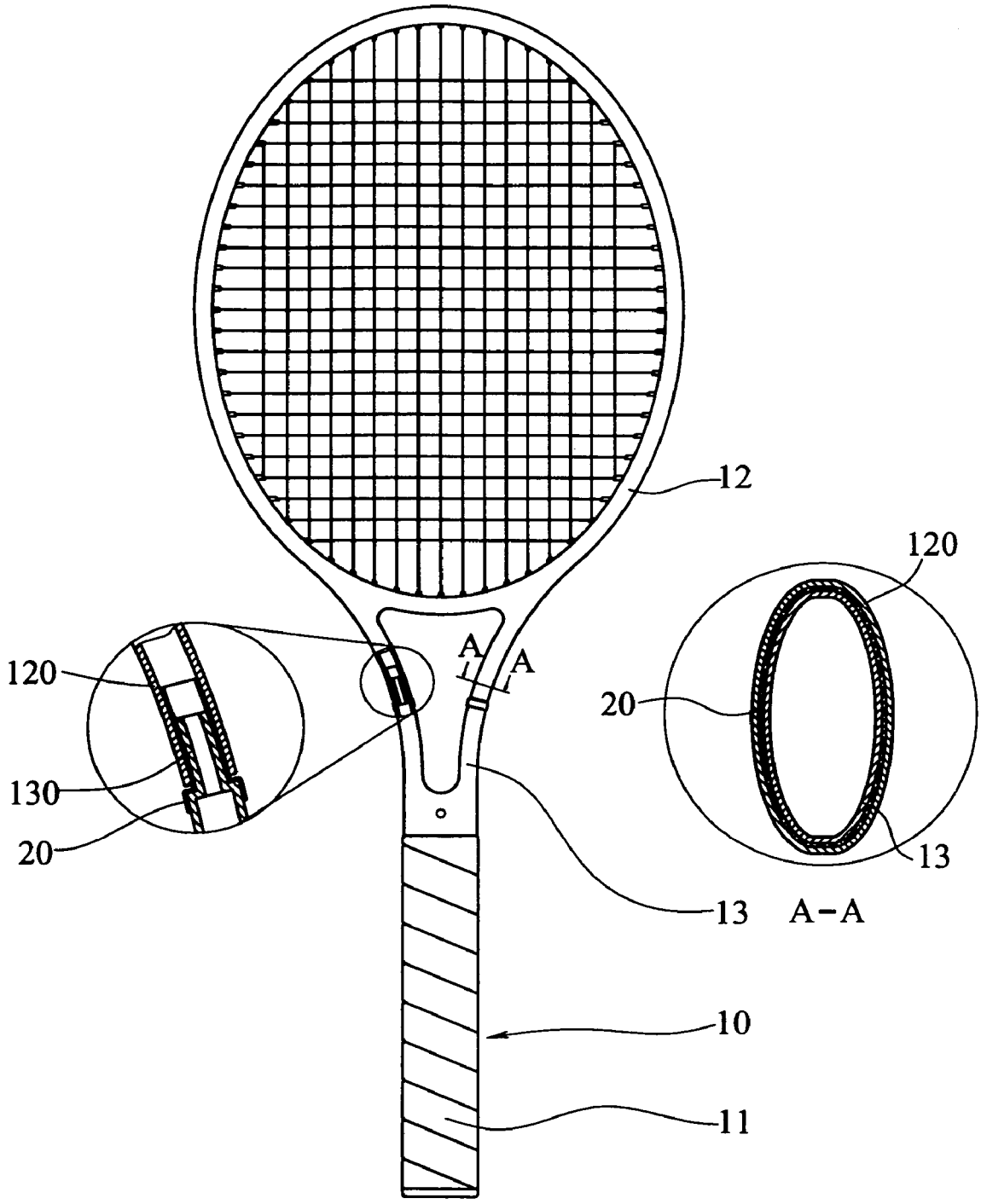
FIG. 4 shows that the shock absorbing members are installed at the throat of the racket of the present invention.
Figures 5, 5A:
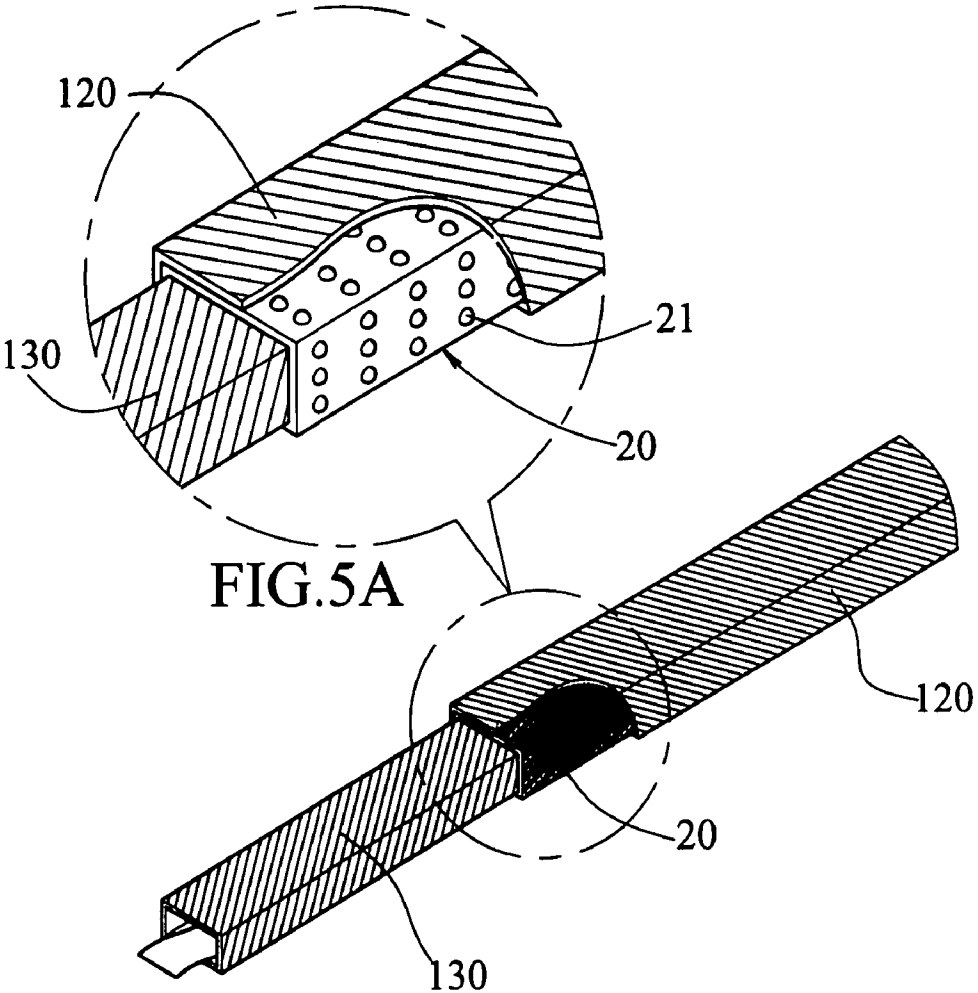
FIGS. 5 and 5A show that the shock absorbing member is wrapped to the insertion of the shaft extension of the racket of the present invention.
Figures 6, 6A:
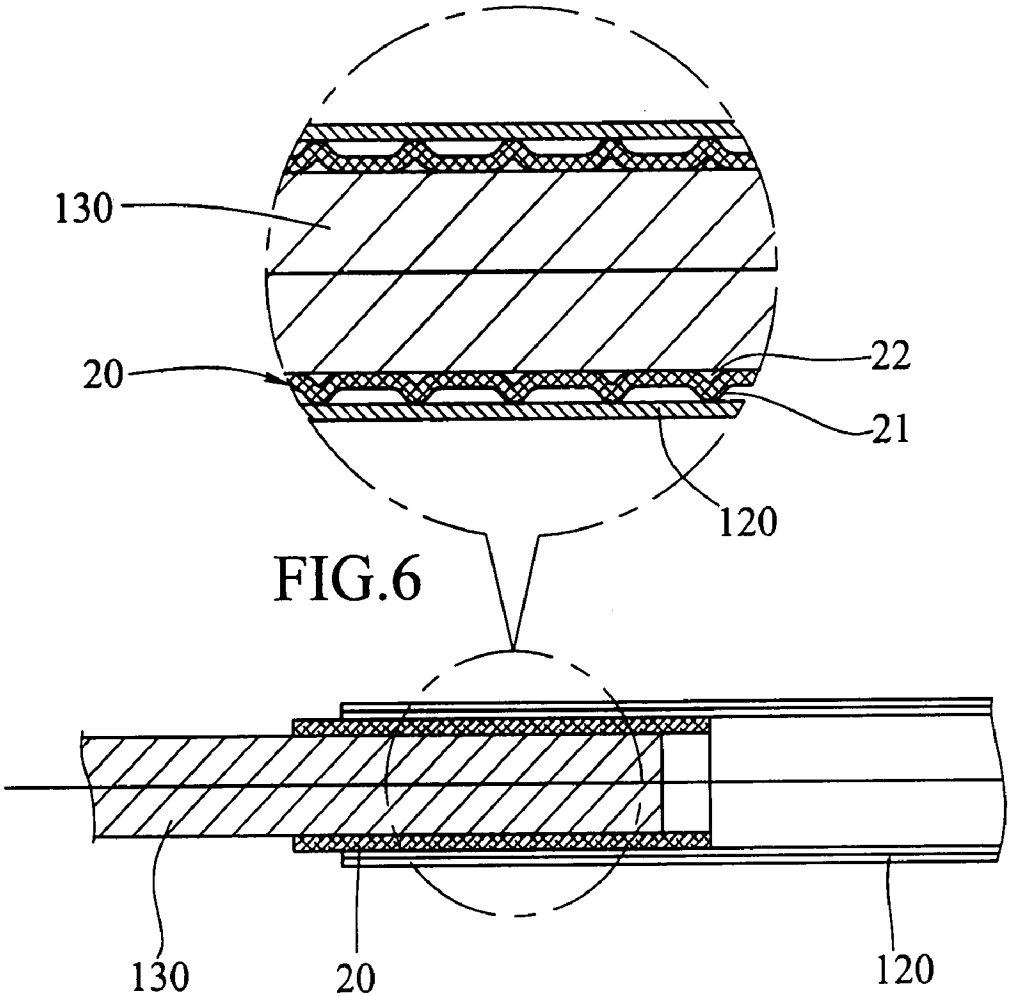
FIGS. 6 and 6A show the cross sections of FIGS. 4 and 4A.

Referring to FIGS. 4, 5, 5A, 6, 6A and 8, the racket 10 of the present invention comprises a head 12, a shaft 11 and a throat which is connected between the head 12 and the shaft 11. The throat is composed of two throat extensions 120 extending from the head 12 and two shaft extensions 13 extending from an end of the shaft 11. Each shaft extension 13 has an insertion 130.

Figure 7:
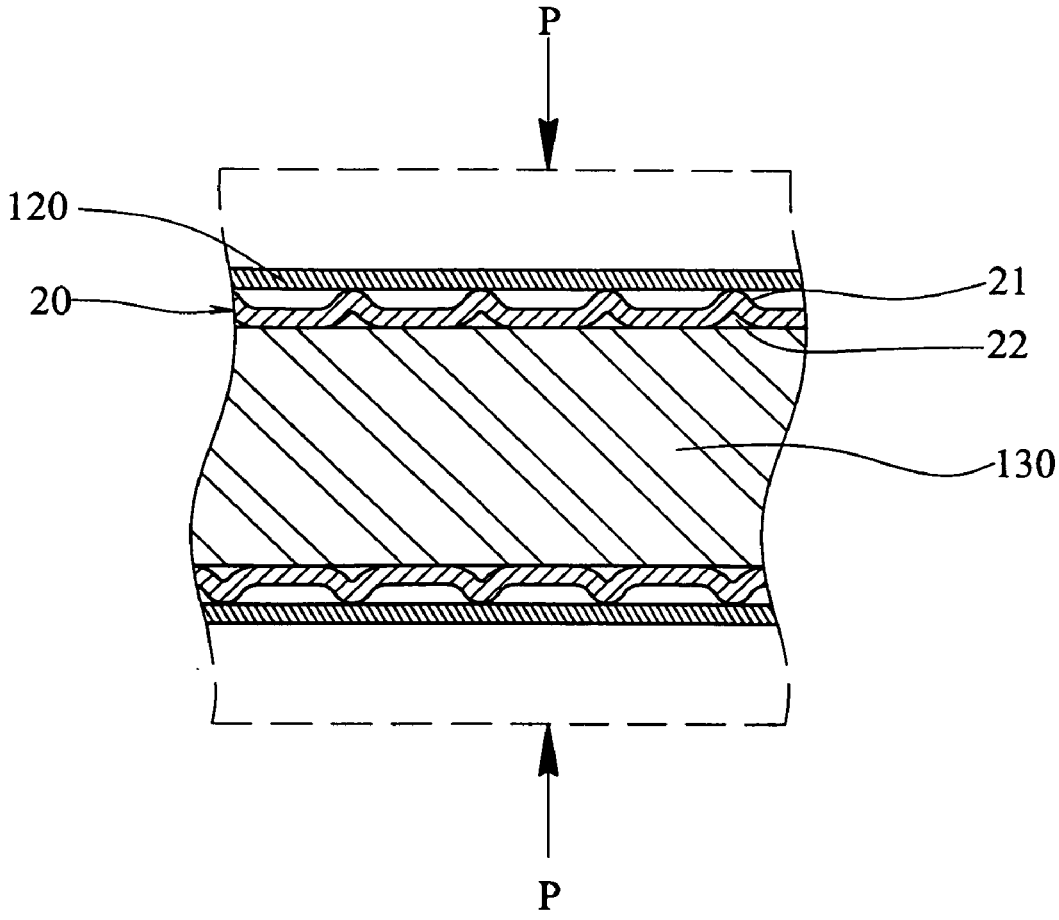
FIGS. 7 and 7A show that the shock absorbing member of the present invention absorbs the force coming from the mold.
Figure 7A:
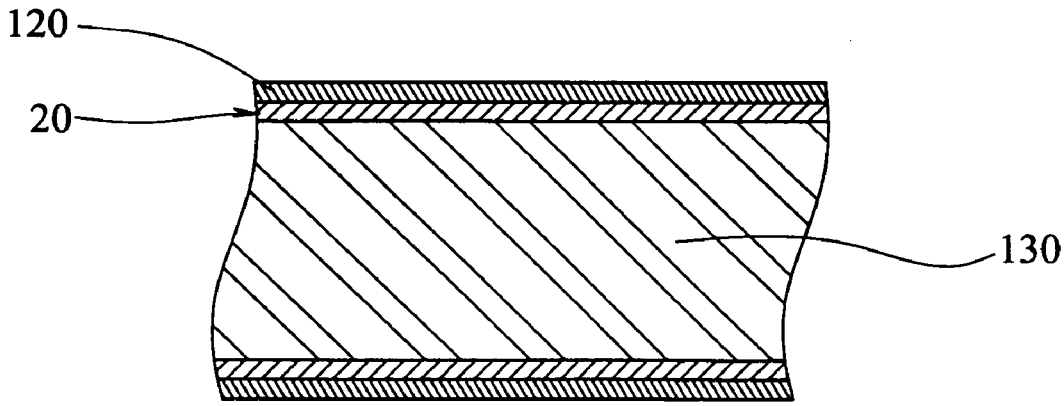
Figure 8:
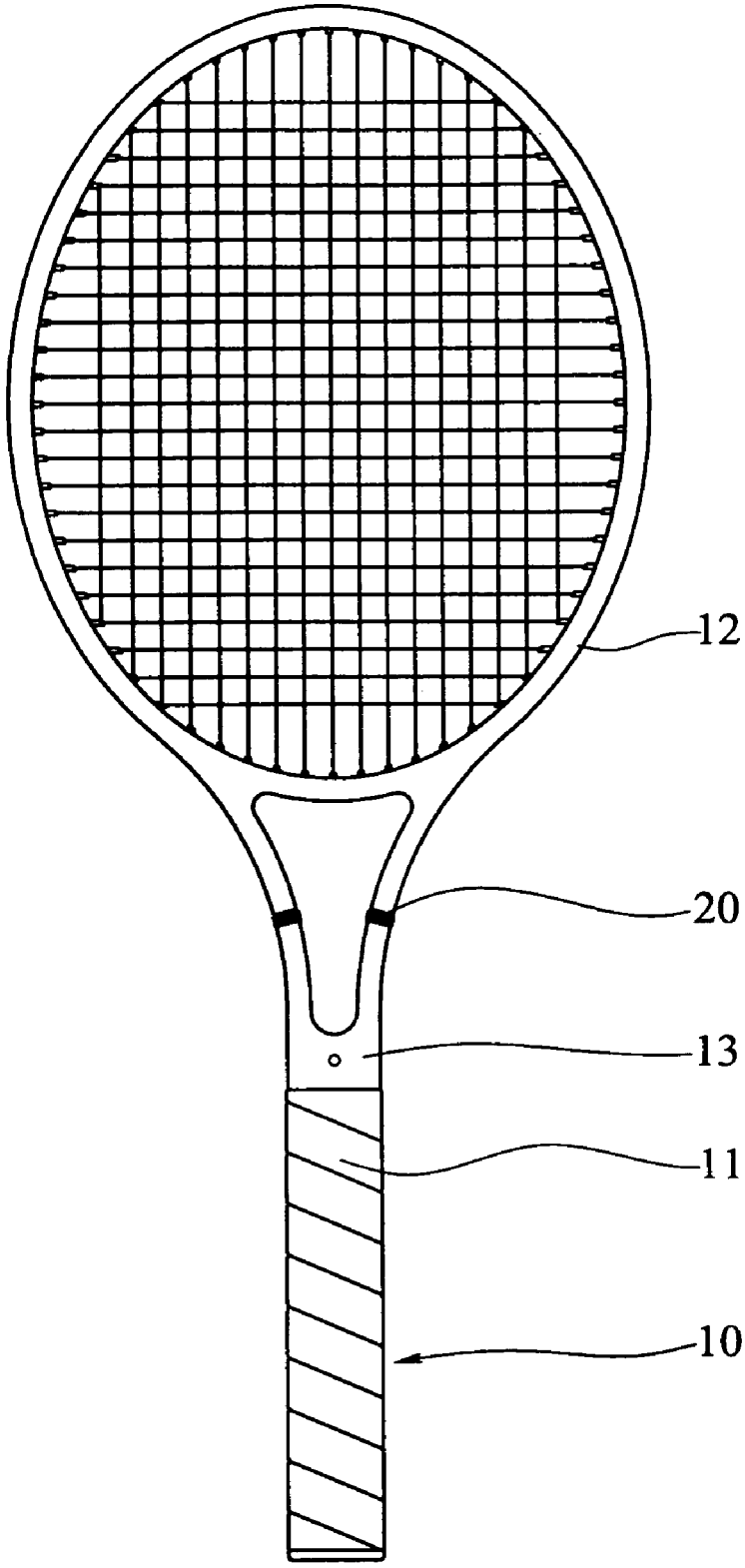
FIG. 8 shows the racket having two shock absorbing members on the throat.

Two shock absorbing members 20 are mounted onto the insertions 130 and the throat extension 120 is mounted to each of the insertions 13 with the shock absorbing members 20. A section of the shock absorbing members 20 extends from an opening of the throat extensions 120 and overlaps on an outer surface of the shaft extensions 13. The shock absorbing members 20 each include protrusions 21 on a first side thereof and recesses 22 defined in a second side. The shock absorbing members 20 have a hardness of A30 to A80. The shock absorbing members 20 are made of rubber or silicone, a melting temperature of the shock absorbing members 20 is higher than that of a material of the racket 10 so that when the racket with prepreg material is put in a mold and heated, the shock absorbing members 20 keep their physical and chemical features. The protrusions 21 of the shock absorbing members 20 absorb the force "P" coming from the mold during molding process and are deformed so as to release stress of the shock absorbing members 20. After the molding process is completed, the shock absorbing members 20 become a flat shock absorbing layers as shown in FIGS. 7 and 7A.

Figure 9:
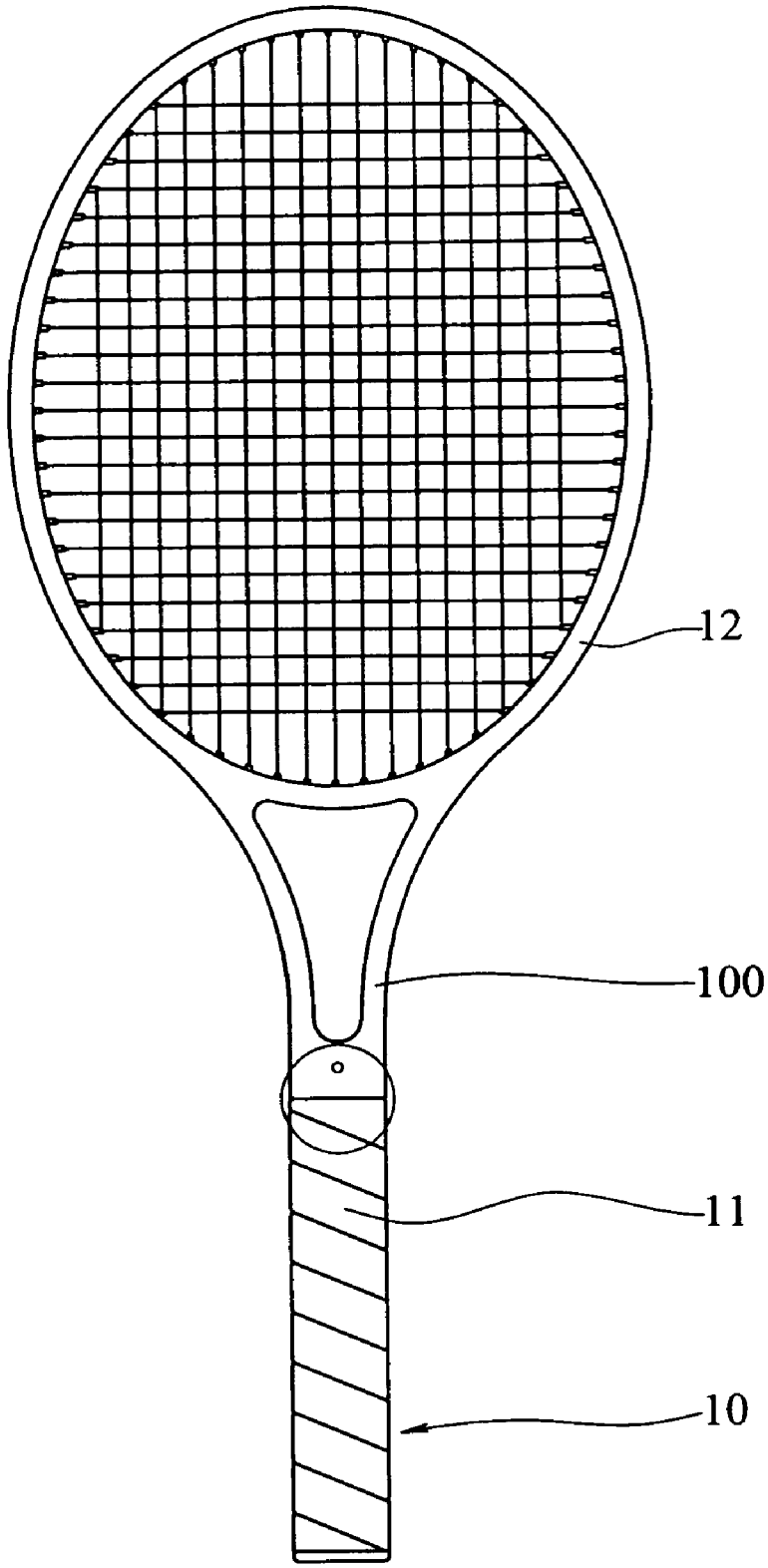
FIG. 9 shows the racket having one shock absorbing member on the shaft.
Figure 10:
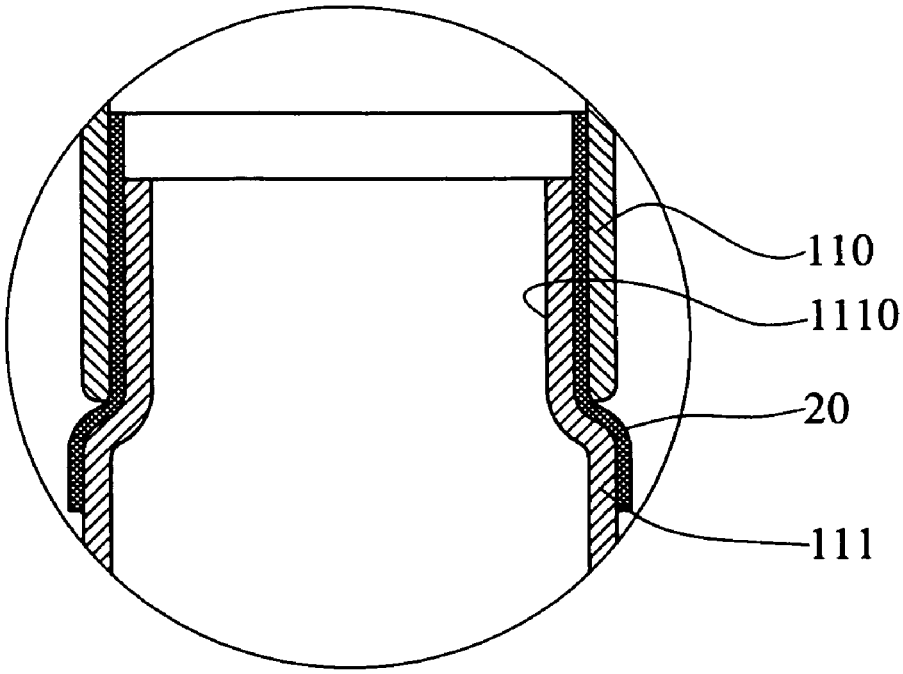
FIGS. 10 and 11 show two different ways of the installation of the shock absorbing members in the shaft.

The shock absorbing member 20 can also be installed at the shaft 11 as shown in FIGS. 9 and 10, wherein the shaft 11 includes a first section 110 which is connected to the throat 100 and has an open end, a second section 111 of the shaft 11 has an insertion 1110 which is inserted into the first section 110 from the open end. A shock absorbing member 20 is mounted onto the insertions 1110 and sandwiched between the first section 110 and the insertion 1110. A section of the shock absorbing member 20 extends from the open end of the first section 110 and overlaps on an outer surface of the second section 111.

Figure 11:
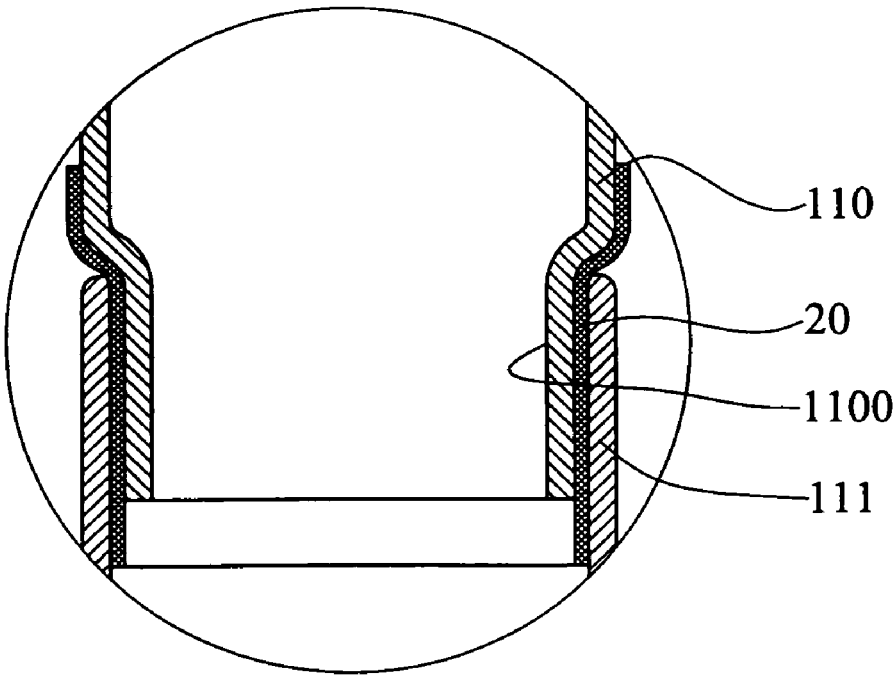

As shown in FIG. 11, there is an alternative way to install the shock absorbing member 20 wherein the shaft 11 includes a first section 110 which is connected to the throat 100 and has an insertion 1100, a second section 111 of the shaft 11 has an open end in which the insertion 1100 is inserted into from the open end. A shock absorbing member 20 is mounted onto the insertions 1100 and sandwiched between the insertion 1110 1100 and the second section 111. A section of the shock absorbing member 20 extends from the open end of the second section 111 and overlaps on an outer surface of the first section 110.

While we have shown and described the embodiment in accordance with the present invention, it should be clear to those skilled in the art that further embodiments may be made without departing from the scope of the present invention.

What is claimed is:

1. A racket 10 comprising:

a head 12 having two throat extensions 120 extending therefrom;

a shaft 11 having two shaft extensions 13 extending from an end thereof and each shaft extension 13 having an insertion 130;

two shock absorbing members 20 mounted onto the insertions 130 and the throat extension 120 mounted to each of the insertions 13 with the shock absorbing members 20, a section of the shock absorbing members 20 extending from an opening of the throat extensions 120 and overlapping on an outer surface of the shaft extensions 13, the shock absorbing members 20 each including protrusions 21 on a first side thereof and recesses 22 defined in a second side.

2. The racket as claimed in claim 1, wherein the shock absorbing members 20 have a hardness of A30 to A80.

3. The racket as claimed in claim 1, wherein the shock absorbing members 20 are made of rubber or silicone, a melting temperature of the shock absorbing members 20 being higher than that of a material of the racket 10.

* * * * *